US005399455A

United States Patent [19]

Mikami et al.

[11] Patent Number: 5,399,455

[45] Date of Patent: Mar. 21, 1995

[54] ELECTROPHOTOGRAPHIC TONER COMPOSITION AND IMAGE FIXING PROCESS

[75] Inventors: Takeshi Mikami; Takashi Imai, both of Minami-ashigara, Japan

[73] Assignee: Fuji Xerox Co., Ltd., Tokyo, Japan

[21] Appl. No.: 49,800

[22] Filed: Apr. 21, 1993

[30] Foreign Application Priority Data

Apr. 22, 1992 [JP] Japan ..... 4-128005

[51] Int. Cl.[6] ..... G03G 9/093

[52] U.S. Cl. ..... 430/138; 430/99

[58] Field of Search ..... 430/138, 99

[56] References Cited

U.S. PATENT DOCUMENTS

| | | | |
|---|---|---|---|
| 3,281,383 | 10/1966 | Zelinski et al. | 260/23.7 |
| 3,726,504 | 4/1973 | Kormos et al. | 251/306 |
| 3,773,695 | 11/1973 | Argabright et al. | 260/2.5 |
| 3,793,265 | 2/1974 | Beck et al. | 260/91 |
| 3,796,696 | 3/1974 | Brown | 260/87 |
| 5,223,370 | 6/1993 | Sacripante et al. | 430/99 |
| 5,246,811 | 9/1993 | Higuchi | 430/138 |

FOREIGN PATENT DOCUMENTS

| | | |
|---|---|---|
| 48-80191 | 10/1973 | Japan . |
| 48-40347 | 11/1973 | Japan . |
| 48-84056 | 11/1973 | Japan . |
| 49-24159 | 6/1974 | Japan . |
| 60-49991 | 3/1985 | Japan . |
| 60-214990 | 10/1985 | Japan . |

*Primary Examiner*—John Goodrow
*Attorney, Agent, or Firm*—Oliff & Berridge

[57] ABSTRACT

An novel electrophotographic toner composition comprising a capsule toner having a core substance containing a binder resin and a coloring agent, encapsulated with a 0.005 to 0.5 μm-thick shell made of resin which comprises a polyurea and/or polyurethane having a glass transition point of 150° C. or lower.

18 Claims, 1 Drawing Sheet

ELECTROPHOTOGRAPHIC TONER COMPOSITION AND IMAGE FIXING PROCESS

FIELD OF THE INVENTION

The present invention relates to a toner composition for the development of an electrostatic image, which contains a capsule toner, and a process for fixing an image with the toner composition.

BACKGROUND OF THE INVENTION

A toner image which has been formed by electrophotography or the like is irreversibly fixed by a fixing procedure to obtain a hard copy. An irreversible fixing process utilizing heat is called "heat fixing process". An irreversible fixing process utilizing pressure alone is called "pressure fixing process". Examples of the heat fixing process include fixing process in which fixing is effected in a non-contact system such as oven fixing process and radiant heating process, fixing process in which fixing is effected in contact with toner images under some pressure such as heat roll fixing process, and fixing process in which light energy is absorbed by a toner to heat and fix the toner such as flash fixing process.

Such a heat fixing process is disadvantageous in that it consumes a considerably large amount of electric power. For example, even the heat roll fixing process, which provides a relatively good thermal efficiency, consumes at its fixing step about half the power consumption of the entire electrophotographic system. It goes without saying that if the toner is molten at a low temperature, the power consumption of the fixing system can be lowered. However, this approach deteriorates the preservability of the toner, causing toner blocking or the like.

SUMMARY OF THE INVENTION

An object of the present invention is to provide an electrophotographic toner composition containing a capsule toner which can be fixed at a low temperature and exhibits an excellent preservability in a heat fixing process.

Another object of the present invention is to provide an electrophotographic toner composition containing a capsule toner which is insusceptible to offset in a heat roll fixing process.

A further object of the present invention is to provide a process for fixing an image using an electrophotographic toner composition as a developer.

These and other objects of the present invention will become more apparent from the following detailed description and examples.

As a result of extensive studies, the inventors found that these objects of the present invention can be accomplished by the use of a specific resin to form a shell of capsule toner, the shell having a specific glass transition point and a specific thickness.

The capsule toner of the present invention comprises a core substance containing a binder resin and a coloring agent, encapsulated with a shell having an average thickness of 0.005 to 0.5 μm and being made of a resin which comprises a polyurea and/or polyurethane having a glass transition point of 150° C. or lower.

Further the image fixing process of the present invention comprises the steps of:

a) providing on a sheet a toner composition containing a capsule toner which comprises a core substance having a glass transition point of 60° C. or lower and being encapsulated with a shell made of a resin capable of allowing permeation of the core substance upon heating at a temperature higher than said glass transition temperature, and b) applying heat and pressure to said capsule toner to an extent that the shell is not ruptured, so that the core substance permeates through the shell to form a fixed image on said sheet.

DETAILED DESCRIPTION OF THE INVENTION

Figure 1:
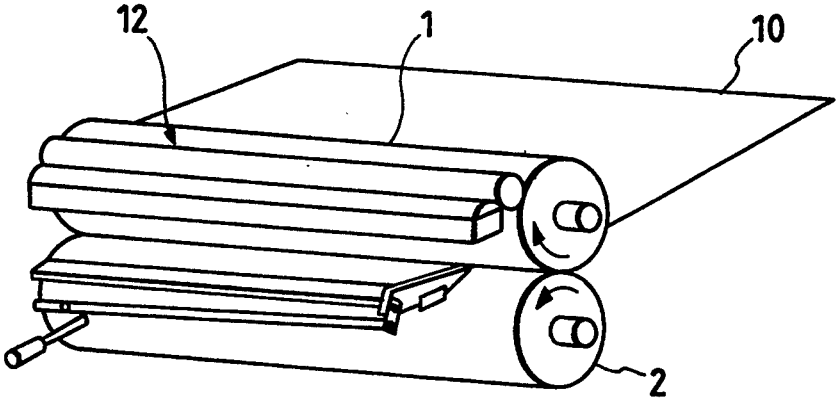
FIG. 1 is a perspective view of an example of the fixing apparatus used in the present invention.

In the present invention, the capsule toner consists of a resin shell and a core substance.

The resin shell is provided in the form of a microcapsule which exhibits sufficient isolatability with respect to the core substance at the storing temperature of the toner. For example, the resin shell isolates the core substance to inhibit the heat agglomeration of the toner even when stored at a temperature of 60° C. for a prolonged period of time, but momentarily exhibits sufficient permeability to the molten core substance at a certain temperature, so that the molten core substance is eluted from the resin shell.

In order to provide the resin shell with the aforementioned functions, the constituent materials of the resin shell, the glass transition point (Tg) of the resin shell, and the thickness of the resin shell should be properly selected. In the present invention, as the shell-forming resin there can be used polyurea and/or polyurethane having a glass transition point of 150° C. or lower, preferably 80° C. to 140° C., in the light of response to process speed and anti-blocking properties. When the glass transition point is higher than 150° C., the fixing temperature is too high to accomplish the effects of the present invention. The glass transition point is measured by differential scanning calorimetry (DSC). More specifically, a resin film prepared on a glass plate is heated at a rate of 5° C./min, and the glass transition point is determined from the shoulder portion of an endothermic curve measured by a differential scanning calory analyzer (Type DT-40 Thermal Analyzer, manufactured by SHIMADZU CORPORATION).

Representative monomer compositions for constituting the resin shell of the present invention are shown below.

$C_2H_5C(CH_2OCONH(CH_2)_6NCO)_3/H_2O$ No. 1

No. 2

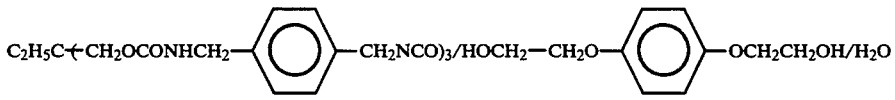

-continued (1st monomer/2nd monomer (weight ratio): 8/2)

No. 3

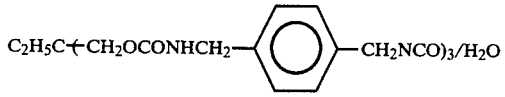

No. 4

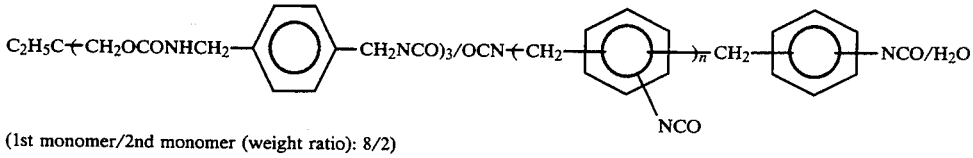

(1st monomer/2nd monomer (weight ratio): 8/2)

In the above monomer compositions, the amount of $H_2O$ as a monomer component is not limited as $H_2O$ is present in a large amount in the reaction system when the resin shell is formed, and n in monomer composition No. 4 represents 0 to 10, preferably 0 to 5 and particularly preferably 0 to 3.

In the present invention, the thickness of the resin shell is in the range of 0.005 μm to 0.5 μm and preferably 0.01 to 0.2 μm. If the thickness of the resin shell exceeds 0.5 μm, the heat response is poor, reducing the permeation of the core substance and hence making it difficult to obtain sufficient fixing strength. If the thickness of the resin shell falls below 0.005 μm, the strength of the resin shell is disadvantageously reduced, making it impossible to accomplish the functions of the shell. The thickness of the aforementioned resin shell can be determined from the following equation:

$$h = \frac{\gamma}{3} \times \frac{(1-p)d_1}{pd_2 + (1-p)d_1}$$

wherein h: Thickness of resin shell;

: Average grain diameter (μm) of microcapsule;

$d_1$: Density of core substance;

$d_2$: Density of resin constituting the shell;

p: Weight proportion of core substance in the total weight of microcapsule

The average grain diameter of microcapsule is a number-average grain diameter determined by Coulter Counter process, light scattering process, centrifugal sedimentation process, or light transmission process, or using electron microscope, etc.

The aforementioned resin shell of the present invention can be formed as follows.

Specifically, the aforementioned resin shell of the present invention may be preferably prepared by emulsifying a core substance containing at least a binder resin and a coloring agent in an aqueous phase, and then forming a resin wall around oil drops of core substance to form microcapsules. In this process, reaction components from which the resin is formed are added to the system inside and/or outside the oil drops. The details of microcapsule which can be used in the present invention, such as a preferred process for preparation of microcapsule are described in U.S. Pat. Nos. 3,726,504, and 3,796,696 which are herein incorporated by reference.

In the case where a polyurethane is formed as a resin shell, a polyisocyanate as a resin shell-forming first substance and a polyol as a resin shell-forming second substance which reacts with the first substance are mixed in an aqueous phase or an oily liquid of a core substance to be capsulated. The mixture is then emulsified in water and heated so that a polymerization reaction occurs on the interface of the oil drops to form a resin shell. In the case where a polyurea is formed as a resin shell, a polyamine is used as the second substance, or the first substance is reacted with water without addition of the second substance.

Polyisocyanates, polyols, and polyamines which can be used in formation of the resin shell are not particularly limited, and known compounds can be used for the purpose, such as those disclosed in U.S. Pat. Nos. 3,281,383, 3,773,695, and 3,793,265, JP-B-48-40347, and 49-24159, and JP-A-48-80191, and 48-84056.

Examples of the polyisocyanate as first substance include diisocynates such as m-phenylenediisocyanate, p-phenylenediisocyanate, 2,6-tolylenediisocyanate, 2,4-tolylenediisocyanate, naphthalene-1,4-diisocyanate, diphenylmethane-4,4'-diisocyanate, 3,3'-dimethoxy-4,4'-biphenyldiisocyanate, 3,3'-dimethylphenylmethane-4,4'-diisocyanate, xylylene-1,4-diisocyanate, 4,4'-diphenylpropanediisocyanate, trimethylenediisocyanate, hexamethylenediisocyanate, propylene-1,2-diisocyanate, butylene-1,2-diisocyanate, cyclohexylene-1,2-diisocyanate and cyclohexylene-1,4-diisocyanate; triisocyanates such as 4,4',4''-triphenylmethane-triisocyanate and toluene-2,4,6-triisocyanate; tetraisocyanates such as 4,4'-dimethyldiphenylmethane-2,2',5,5'-tetraisocyanate; and isocyanate prepolymers such as adduct of hexamethylenediisocyanate and trimethylolpropane, adduct of 2,4-tolylenediisocyanate and trimethylolpropane, adduct of xylylenediisocyanate and trimethylolpropane, and adduct of tolylenediisocyanate and hexanetriol.

Examples of the polyol as second substance include aliphatic or aromatic polyhydric alcohol, hydroxypolyester, and hydroxypolyalkylene ether.

Further, polyols described in JP-A-60-49991 can be used, such as ethylene glycol, 1,3-propanediol, 1,4-butanediol, 1,5-pentanediol, 1,6-hexanediol, 1,7-heptanediol, 1,8-octanediol, propylene glycol, 2,3-dihydroxybutane, 1,2-dihydroxybutane, 1,3-dihydroxybutane, 2,2-dimethyl-1,3-propanediol, 2,4-pentanediol, 2,5-hexanediol, 3-methyl-1,5-pentanediol, 1,4-cyclohexanedimethanol, dihydroxycyclohexane, diethylene glycol, 1,2,6-trihydroxyhexane, 2-phenylpropylene glycol, 1,1,1-trimethylolpropane, hexanetriol, pentaerythritol, condensation products of aromatic polyhdric alcohol and alkylene oxide (e.g., pentaerythritol-ethylene oxide adduct, glycerin-ethylene oxide adduct, glycerin, 1,4-di(2-hydroxyethoxy)benzene and resorcinol dihydroxyethyl ether), p-xylylene glycol, m-xylylene glycol, α,α'-dihydroxy-p-diisopropylbenzene, 4,4'-dihydroxydiphenylmethane, 2-(p,p'-dihydroxydiphenylmethyl)- benzylalcohol, ethylene oxide adduct of bisphenol A, and propylene oxide adduct of bisphenol A. The polyol is preferably used in a proportion of 0.02 to 2 mols per mol of isocyanate as calculated in terms of hydroxyl group.

Examples of the polyamine include ethylene diamine, trimethylene diamine, tetramethylene diamine, pentamethylene diamine, hexamethylene diamine, p-phenylene diamine, m-phenylene diamine, piperazine, 2-methylpiperazine, 2,5-dimethylpiperazine, 2-hydroxytrimethylenediamine, diethylenetriamine, triethylenetriamine, triethylenetetramine, diethylaminopropylamine, tetraethylenepentamine, and amino adduct of epoxy compound. The polyamine is preferably used in a proportion of 0.01 to 0.5 mol per mol of isocyanate as calculated in terms of amino group.

In the present invention, the core substance of the capsule toner comprises a binder resin and a coloring agent.

The binder resin to be used in the present invention is not specifically limited. Examples include polystyrene and copolymer thereof, polyester and copolymer thereof, polyethylene and copolymer thereof, epoxy resin, (meth)acrylate resin and copolymer thereof, silicone resin, polypropylene and copolymer thereof, wax, fluorine-containing resin, polyamide resin, polyvinyl alcohol resin, and polyurethane resin.

In the present invention, the resin shell can prevent the core substance from leaking from the microcapsule, making it possible to use a low melting resin which cannot be used in the prior art due to occurrence of heat blocking, i.e., resin having Tg of 60 ° C. or lower.

Among these binder resins, preferred are polyesters, particularly those having a molecular weight of 1,000 to 20,000, taking into account the coloring properties after fixing, image strength, etc. In particular, linear polyesters obtained by polycondensation reaction of a polyol component with a polycarboxylic acid, an acid anhydride thereof, or a lower alkyl ester thereof are preferably used. Preferred examples of such polyol components include diols represented by general formula (I) or (II):

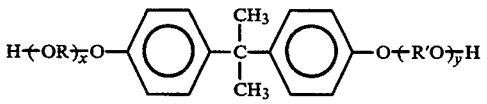

(I)

$$HO-(CH_2)_m-OH \quad (II)$$

wherein R and R' each represents an ethylene or propylene group; x and y each represents an integer of 1 to 15, preferably 2 to 10, more preferably 3 to 8; and m represents an integer of 2 to 6.

As the diols represented by formula (I) there may be preferably used polyoxypropylene(2,2)-2,2-bis(4-hydroxyphenyl)propane, and polyoxypropylene(3,3)-2,2-bis(4-hydroxyphenyl)propane.

As the diols represented by formula (II) there may be preferably used ethylene glycol, 1,3-propylene glycol, and 1,4-butanediol.

In the present invention, these diols may be used singly or as admixture thereof.

Examples of the polycarboxylic acid include dicarboxylic acids such as phthalic acid, isophthalic acid, terephthalic acid, fumaric acid, maleic acid and succinic acid, and tricarboxylic acids such as 1,2,4-benzenetricarboxylic acid, 2,5,7-naphthalenetricarboxylic acid and 1,2,4-naphthalenetricarboxylic acid.

These polycarboxylic acids can be used singly or as admixture thereof.

The aforementioned polyester can be used in combination with other resins, such as polystyrene, styrene-alkyl methacrylate copolymer, styrene-alkyl acrylate copolymer, styrene-acrylonitrile copolymer, styrene-butadiene copolymer, styrene-maleic anhydride copolymer, polyethylene, and polypropylene. However, the polyester is preferably contained in an amount of 10 wt% or more based on the weight of the binder resin.

Typical examples of the coloring agent include carbon black, nigrosine, aniline blue, chalcoyl blue, chrome yellow, ultramarine blue, Du Pont oil red, quinoline yellow, methylene blue chloride, phthalocyanine blue, malachite green oxalate, lamp black, rose bengal, C. I. pigment red 48:1, C. I. pigment red 122, C. I. pigment red 57:1, C. I. pigment yellow 97, C. I. pigment yellow 12, C. I. pigment blue 15:1, and C. I. pigment blue 15:3. The coloring agent is generally contained in an amount of 1 to 10 wt% based on the weight of the core substance.

The capsule toner of the present invention may contain in the core substance a heat fixing accelerator selected from the group consisting of aromatic hydroxyl compounds, carbamic ester compounds, aromatic methoxy compounds and organic sulfonamide compounds.

Use of these compounds improve permeation rate of the core substance through the shell wall at an elevated temperature while the shell is kept from being ruptured. In particular, if a polyester is used as a binder resin, the eutectic point therewith is lowered, further improving the fixability of the core substance.

The heat fixing accelerators having a melting point of 50° C. to 170° C. are preferably used for the purpose, with aromatic hydroxyl compounds (especially diol compounds thereof) being particularly preferred.

Examples of the aromatic hydroxyl compound include phenol compounds such as p-t-butyl-phenol, p-t-octylphenol, p-α-cumylphenol, p-t-pentylphenol, m-xylenol, 2,5-dimethylphenol, 2,4,5-trimethylphenol, 3-methyl-4-isopropylphenol, pbenzylphenol, o-cyclohexylphenol, p-(diphenylmethyl)phenol, p-(α,α-diphenylethyl)phenol, o-phenylphenol, ethyl p-hydroxybenzoate, propyl p-hydroxybenzoate, butyl p-hydroxybenzoate, benzyl p-hydroxybenzoate, p-methoxyphenol, p-butoxyphenol, p-heptyloxyphenol, p-benzyloxyphenol, dimethylvalinine 3-hydroxyphthalate, 1,1-bis(4-hydroxyphenyl)dodecane, 1,1-bis(4-hydroxyphenyl)-2-ethylhexane, 1,1-bis(4-hydroxyphenyl)-2-methylpentane, 2,2-bis(4-hydroxyphenyl)heptanevaniline, 2-t-butyl-4-methoxyphenol, 2,6-dimethoxyphenol, and 2,2'-dihydroxy-4-methoxybenzophenone; and alcohol compounds such as 2,5-dimethyl-2,5-hexanediol, resorcinol di(2-hydroxyethyl)ether, resorcinol mono(2-hydroxyethyl)ether, salicyl alcohol, 1,4-di(hydroxyethoxy)benzene, p-xylylenediol, 1-phenyl-1,2-ethanediol, diphenylmethanol, 1,1-diphenylethanol, 2-methyl-2-phenyl-1,3-propanediol, 2,6-dihydroxymethyl-p-cresolbenzyl ether, 2,4-dihydroxymethyl-p-cresolbenzyl ether, and 3-(o-methoxyphenoxy)-1,2-propanediol.

Examples of the carbamic ester compound include ethyl N-phenylcarbamate, benzyl N-phenylcarbamate, phenethyl N-phenylcarbamate, benzyl carbamate, butyl carbamate, and isopropyl carbamate.

Examples of the aromatic methoxy compound include 2-methoxybenzoic acid, 3,5-dimethoxyphenyl acetate, 2-methoxynaphthalene, 1,3,5-trimethoxybenzene, p-dimethoxybenzene, and p-benzyloxymethoxybenzene.

As the organic sulfonamide there can be used any known organic sulfonamide. Examples include p-toluenesulfonamide, o-toluenesulfonamide, benzenesulfonamide, p-toluenesulfonanilide, N-(p-methoxyphenyl)-p-toluenesulfonamide, N-(o-methoxyphenyl)-p-toluenesulfonamide, N-(p-chlorophenyl)-p-toluenesulfonamide, N-(o-chlorophenyl)-ptoluenesulfonamide, N-(p-tolyl)-p-toluenesulfonamide, N-(o-tolyl)-p-toluenesulfonamide, N-(o-hydroxyphenyl)-ptoluenesulfonamide, N-benzyl-p-toluenesulfonamide, N-(2-phenethyl)-p-toluenesulfonamide, N-(2-hydroxyethyl)-ptoluenesulfonamide, N-(3-methoxypropyl)-p-toluenesulfonamide, methanesulfonanilide, N-(p-tolyl)-sulfonamide, N-(o-tolyl)sulfonamide, N-(p-methoxyphenyl)sulfonamide, N-(o-methoxy)sulfonamide, N-(p-chlorophenyl)sulfonamide, N-(o-chlorophenyl)sulfonamide, N-(2,4-xylyl)sulfonamide, N-(p-ethoxyphenyl)-sulfonamide, N-benzylmethanesulfonamide, N-(2-phenoxyethyl)methanesulfonamide, 1,3-bis(methanesulfonylamino)benzene, and 1,3-bis(p-toluenesulfonylamino)propane.

These compounds can be added to the core substance, preferably in an amount of 0.01 to 10 parts by weight, more preferably 0.1 to 5 parts by weight per part by weight of the total weight of the binder resin and the coloring agent.

In the present invention, the core substance is added to an aqueous phase in the form of solution or dispersion in an organic solvent and then emulsified in an aqueous medium. Preferred examples of the organic solvent include ethyl acetate, isopropyl acetate, butyl acetate, and methylene chloride.

A protective colloid may previously be incorporated in the aqueous phase with which the oil phase, i.e., core substance is mixed. As such a protective colloid there may be used water-soluble high molecular compounds such as known anionic, nonionic, or amphoteric high molecular compounds. Particularly preferred are polyvinyl alcohol, gelatin, and cellulose derivatives.

The aqueous phase may further contain a surface active agent. The a surface active agent can be properly selected from anionic or nonionic surface active agents such that the surface active agent does not act on the aforementioned protective colloid to cause precipitation or agglomeration. Preferred examples of such a surface active agent include sodium alkylbenzenesulfonate (e.g., sodium laurylsulfate), dioctylsodium sulfosuccinate, and polyalkylene glycol (e.g., polyoxyethylene nonyl phenyl ether).

The grain size of the capsule toner is preferably in the range of 20 μm or less, particularly 4 μm or less as calculated in terms of volume-average grain size determined by the method described in JP-A-60-214990 in the light of improvement in the image resolving power, preservability, and handling properties.

If the grain size is too small, the resin shell is too thin, and some difficulties occure when performing an electrophotographic process. Thus, the lower limit of the grain size is preferably 0.1 μm or more.

In the present invention, the capsule toner can be obtained by forming a resin shell around a core substance to form microcapsules in an aqueous phase, separating these microcapsules from the aqueous phase, washing these microcapsules with water, and then drying them. The operation for separation and drying the microcapsules can be ordinarily effected by drying a slurry containing the microcapsules.

The capsule toner may contain a known additives such as charge controlling agent and fixing aid, if desired.

The electrophotographic toner composition of the present invention may be a either one-component developer requiring no carrier or a two-component developer requiring a carrier, with the latter being preferred.

In the case of two-component developer, a carrier is not specifically limited and iron powder carrier, ferrite carrier, surface-coated ferrite carrier, magnetic powder dispersion type carrier or the like can be used.

For the purpose of improving the toner fluidity or controlling the chargeability, various additives may be added in the toner composition of the present invention. Examples of such fluidizing agents include silicon oxide, titanium oxide, zirconium oxide, aluminum oxide, and those hydrophobicized by a conventional surface treatment, as well as a cleaning aid or transferring aid such as polystyrene grains, polymethyl methacrylate grains and polyvinylidene fluoride grains. These additives may be added in an amount of 0.05 to 10 wt% preferably 0.1 to 5 wt%, based on the weight of capsule toner in the toner composition.

In the electrophotographic toner composition of the present invention, it is preferred that these additives are adhered to the surface of the toner grains, and this can be accomplished by any known means such as high-speed mixer, for example, Henschel mixer and V-shaped blender.

The electrophotographic toner composition of the present invention can be used as a developer which is fixed in a heat fixing process after development or the subsequent transfer.

The image fixation can be effected by an ordinary method which comprises forming an electrostatic latent image on an electrophotographic photoreceptor, developing the electrostatic latent image with an electrophotographic toner composition to form a toner image, transferring the toner image onto a receiving material, and then heat-fixing the toner image to obtain a copy image. The heat-fixing temperature is generally from 100° to 180° C. and preferably from 110° to 170° C.

As the heat fixing process there may be used either non-contact process such as oven, radiant and flash fixing process or contact process such as heat roll fixing process.

A preferred embodiment of the present invention is to fix a toner image in the following manner:

a) providing on a sheet a toner composition containing a capsule toner which comprises a core substance having a glass transition point of 60° C. or lower and being encapsulated with a shell made of a resin capable of allowing permeation of the core substance upon heating at a temperature higher than the glass transition temperature, and b) applying heat and pressure to the capsule toner to an extent that the shell is not ruptured, so that the core substance permeates through the shell to form a fixed image on the sheet.

The present invention will be further described in the following Examples, but the present invention should not be construed as being limited thereto. The term "part" as used herein means "part by weight".

EXAMPLE 1

A. Preparation of toner

Two parts of a linear polyester resin (Tg: 46° C.; melting point (Tm): 79.5° C.; acid value: 2.7; hydroxyl number: 34.4) and 2 parts of a copper phthalocyanine pigment (Phthalocyanine Blue 4933M, produced by Dainichiseika Colour & Chemicals Mfg. Co., Ltd.) were mixed with 200 parts of ethyl acetate. The mixture was then milled by a sand mill to prepare a dispersion.

In 20 parts of the dispersion were dissolved 10 parts of the aforementioned linear polyester resin and 3 parts of an adduct of 3 mols of xylylene diisocyanate and 1 mol of trimethylol propane (Takenate D-110N, produced by Takeda Chemical Industries, Ltd.) to prepare an oily mixture. In the preparation of this oily mixture (a mixture of a core substance and a shell-forming material), the liquid temperature was adjusted to 25° C. or lower.

The oily mixture was then emulsified in 80 parts of a 0.1 wt.% aqueous solution of polyvinyl alcohol to obtain an oil-in-water type emulsion having oil drops with an average grain size of 3 μm. The oil-in-water type emulsion was stirred at 50° C. for 3 hours to complete the interfacial polymerization reaction. The microcapsule dispersion thus obtained was then processed by a centrifugal separator to cause the microcapsules to be sedimented. The upper aqueous phase was then discarded from the system. A washing water was then added to the system. The system was then stirred for redispersion. This washing operation was repeated 6 times to remove deposits such as polyvinyl alcohol from the surface of the microcapsules. To the microcapsules thus obtained were added 100 parts of distilled water. The resultant was then dried by means of a freeze dryer to remove water therefrom. Thus, a colored capsule toner was obtained.

Tg of the shell resin in the colored capsule toner was 130° C. The thickness of the shell was 0.09 μm.

B. Evaluation of fixability

Figure 2:
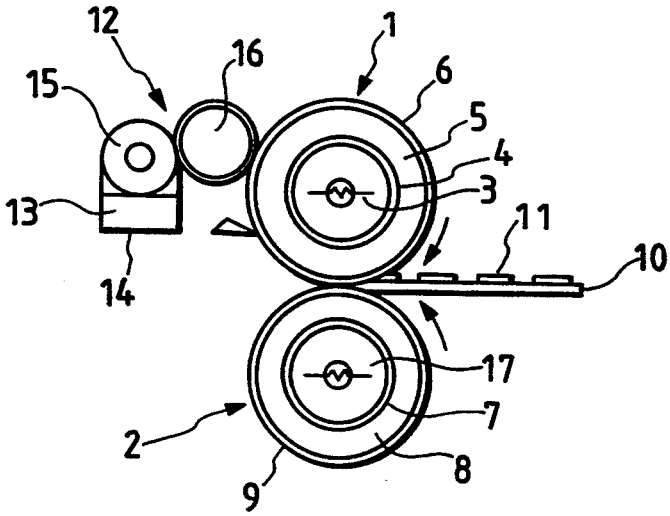
FIG. 2 is a typical side section of the fixing apparatus of FIG. 1.

The fixing apparatus used in the present invention will be described with reference to the drawings. FIG. 1 is a perspective view of an example of such a fixing apparatus. FIG. 2 is a typical side section of the fixing apparatus.

Referring to FIG. 2, this fixing apparatus essentially comprises heat roll 1 and pressure roll 2. The heating roll comprises base roll 4 in which heat source 3 is provided, inner elastic layer 5 disposed on base roll 4, and outer elastic layer 6 disposed on layer 5.

Pressure roll 2 comprises base roll 7 in which heat source 17 is provided, and inner elastic layer 8 and outer elastic layer 9 are disposed on base roll 7 in sequence. Behind heat roll 1 is provided release agent supplying means 12. In operation, silicone composition 13 as a release agent in oil pan 14 is supplied via supplying roll 15 onto coating roll 16 provided in contact with heat roll 1. Shown at 10 and 11 are a receiving sheet and a toner image, respectively.

In more detail, heat roll 1 has 500-W quartz lamp 3 provided therein and comprises base roll 4 (outer diameter: 44 mm) formed of a steel core material. Inner elastic layer 5 having a rubber hardness of 60° as determined by JIS hardness and a thickness of 3 mm was formed on base roll 4 via an appropriate primer layer by packing and mixing 100 parts of a silicone compound (SH841U, produced by Toray Industries Inc.), 100 parts of crystalline silica and 0.8 parts of a vulcanizing agent (RC-4, produced by Toray Industries Inc.). Outer elastic layer 6 having a thickness of 40 mm was further formed thereon by packing and mixing 100 parts of a fluorine-containing rubber (Vyton rubber B-50, produced by Du Pont), 2 parts of carbon black (Thermal Black MT, produced by Cabot) and 10 parts of magnesium oxide (MgO: #30, produced by Kyowa Kagaku K. K.).

Pressure roll 2 has a 500-W quartz lamp 17 provided therein and comprises base roll 7 (outer diameter: 48 mm) formed of a steel core material. Inner elastic layer 8 having a rubber hardness of 60° as determined by JIS hardness and a thickness of 1 mm was formed on the base roll 7 via an appropriate primer layer by packing and mixing 100 parts of a silicone compound (SH841U), 50 parts of crystalline silica, and 0.8 parts of a vulcanizing agent (RC-4). Outer elastic layer 9 having a thickness of 40 mm was further formed thereon by packing and mixing 100 parts of a fluorine-containing rubber (Vyton rubber B-50), 2 parts of carbon black (Thermal Black MT), and 10 parts of magnesium oxide (MgO: #30).

Heating roll 1 and pressure roll 2 were brought into pressure contact with each other by a pressing means (not shown) to form a 6-mm wide nip therebetween. Heating roll 1 and pressure roll 2 rotated at a surface speed of 150 mm/sec. in the direction shown by the arrow.

An amino-denatured oil was supplied into the fixing apparatus to conduct a fixing test. The aforementioned colored capsule toner was scattered through a 45-μm sieve to form a solid image with an average thickness of 0.65 mg/cm$^2$. In order to inhibit the image flow during fixing, the image was irradiated with corotron. A fixing test was conducted, and as a result, fixing could be effected at a fixing temperature as low as 120° C. A fixed toner image exhibited a sufficient image strength.

C. Evaluation of preservability

A capsule toner prepared according to the present invention and a toner free of shell (i.e., made only of a binder resin and a pigment) were evaluated for preservability.

The shell-free toner was prepared in the same manner as in Section A (preparation of toner) except that no shell-forming substance was added to the oil phase. Agglomeration was observed when the shell-free toner was allowed to stand at 30° C. and 90% RH for 24 hours. On the other hand, the toner of the present invention was free from aggolomeration even after storing under the same conditions.

EXAMPLE 2

With the capsule toner obtained in Section A of Example 1 were blended 1% by weight of an amorphous titania (which had an average grain diameter of 20 nm and had been surface-treated with 10% by weight of methyl trimethoxy silane) and 0.8% by weight of a hydrophobic silica having an average grain diameter of 40 nm by means of a Henschel mixer, whereby these fine grains were attached onto the surface of the capsule toner.

Five parts of the thus prepared toner was added to 100 parts of a carrier made of a methyl methacrylate-styrene copolymer-coated ferrite having a grain diameter of about 50 μm. The mixture was then fully mixed by means of a tumbler shaker mixer to obtain a developer (toner composition).

The developer was then supplied into a copy machine (remodelled A Color 630 manufactured by Fuji Xerox) for copy test. As a result, an excellent image was obtained at a fixing temperature of 120° C.

EXAMPLE 3

In order to vary the shell thickness, the amount of Takenate D-110N as a shell-forming substance was changed to 2 or 5 parts in Section A of Example 1, whereby capsule toners A and B having an average grain diameter of 5 μm (as calculated in terms of number-average grain diameter determined by Coulter Counter process) were prepared.

Tg of the shell of capsule toners A and B were each 138° C. The thicknesses of the shell of the capsule toners A and B were 0.15 μm and 0.55 μm as calculated, respectively.

These capsule toners were then evaluated for preservability and fixability in the same manner as in Example 1. Both the two capsule toners exhibited an excellent preservability. As a result of the fixing test, capsule toner A could be fixed at 120° C., whereas capsule toner B was not satisfactorily fixed even at 170 ° C. and could not provide a sufficient image strength.

COMPARATIVE EXAMPLE

Three parts of a mixture (3:1 by weight) of xylylene diisocyanate and polymethylene polyphenyl polyisocyanate (Millionate MR, produced by Nihon Polyurethane K. K.) was used as a shell-forming substance in place of the adduct of 3 mols of xylylene diisocyanate and 1 mol of trimethylol propane to prepare an oily mixture in the same manner as in Example 1. The oily mixture was then emulsified in 80 parts of a 0.1 wt% aqueous solution of polyvinyl alcohol containing 0.5 part of diethylenetriamine to obtain an oil-in-water type emulsion having oil drops with an average grain size of 3 μm. Subsequently, the same procedure as in Example 1 was carried out to obtain a colored capsule toner having an average grain diameter of 3 μm. Tg of the shell of the obtained capsule toner was 160 ° C. and the thickness of the shell was 0.09 μm.

The comparative capsule toner was then evaluated for preservability and fixability. As a result, it was found that the comparative capsule toner was not fully fixed even at 170 ° C. and did not provide a sufficient image strength though it exhibited an excellent preservability.

EXAMPLE 4

A. Preparation of Toner

Two parts of a linear polyester resin (Tg: 46° C.; Tm: 79.5° C.; acid value: 2.7; hydroxyl number: 34.4) and 2 parts of a copper phthalocyanine pigment (Phthalocyanine Blue 4933M) were mixed with 200 parts of ethyl acetate. The mixture was then milled by a sand mill to prepare a dispersion.

In 20 parts of the dispersion were dissolved 10 parts of the aforementioned linear polyester resin, 1 part of p-xylylenediol (m.p. 115°–116° C.), 1 part of an adduct of 3 mols of xylylene diisocyanate and 1 mol of trimethylol propane (Takenate D-110N), and 0.2 parts of a polyisocyanate (Millionate MR-400, produced by Nihon Polyurethane Kogyo K. K.) to prepare an oily mixture. In the preparation of this mixture (a mixture of a core substance and a shell-forming material), the liquid temperature was adjusted to 25° C. or lower. Separately, 0.3 parts of diethylenetriamine were added to 80 parts of a 0.1 wt.% aqueous solution of polyvinyl alcohol. In the aqueous solution was emulsified the aforementioned mixture to obtain an oil-in-water type emulsion having oil drops with an average grain size of 3 μm. The oil-in-water type emulsion was stirred at 50° C. for 3 hours to complete the interfacial polymerization reaction. The microcapsule dispersion thus obtained was then processed by a centrifugal separator to cause the microcapsules to be sedimented. The upper aqueous phase was then discarded from the system. A washing water was then added to the system. The system was then stirred for redispersion. This washing operation was repeated 6 times to remove deposits such as polyvinyl alcohol from the surface of the microcapsules. To the microcapsules thus obtained were added 100 parts of distilled water. The material was then dried by means of a freeze dryer to remove water. Thus, a colored capsule toner was obtained.

Tg of the shell resin in the colored capsule toner was 130° C., and the thickness of the shell was about 0.02 μm.

B. Evaluation of fixability

A fixing test was conducted by means of the same fixing apparatus as used in Example 1. The aforementioned color toner grains were scattered through a 45-μm sieve to form a solid image having an average thickness of 0.65 mg/cm$^2$. In order to inhibit the image flow, the image was irradiated with corotron.

A fixing test was conducted under the aforementioned conditions. As a result, color development was effected at a fixing temperature as low as 120° C. Thus, a fixed image having a sufficient image strength for copy image was obtained.

C. Evaluation of preservability

The aforementioned colored toner grains were then evaluated for preservability.

These colored toner grains were free from agglomeration and deterioration even after storage at 35° C. and 90% RH for 24 hours.

EXAMPLE 5

Toner grains were prepared in the same manner as in Example 4 except that a linear polyester resin (Tg: 53.6° C.; Tm: 90.2° C.; acid value: 1.3; hydroxyl number: 26.8) was used. The toner was then evaluated for fixability and preservability in the same manner as in Example 4.

The toner was color-developed at a fixing temperature as low as 131° C. under the fixability evaluation conditions described in Section B of Example 4. Thus, a fixed toner image having a sufficient image strength for copy image was obtained. The toner was then evaluated for preservability under the conditions described in Section C of Example 4. As a result, neither agglomeration nor deterioration was observed.

EXAMPLE 6

Toner grains were prepared in the same manner as in Example 4 except that a carbon black (#44, produced by Mitsubishi Kasei Corporation) was used instead of the copper phthalocyanine pigment. The toner was then evaluated for fixability and preservability in the same manner as in Example 4.

The toner was fixed at a temperature as low as 122° C. under the fixability evaluation conditions described in Section B of Example 4, and the fixed toner image had a sufficient image strength. The toner was also evaluated for preservability under the conditions described in Section C of Example 4, and it was found that the toner was free from agglomeration and deterioration.

EXAMPLES 7 TO 9

Toner grains were prepared in the same manner as in Example 4 except that the heat fixing accelerators mentioned below were used in place of p-xylylenediol. The toner was then evaluated for fixability and preservability in the same manner as in Example 4. The results are set forth in Table 1. Table 1 shows that these toners can be fixed at a low temperature and exhibit satisfactory color developability and fixing strength. These toners exhibit an excellent preservability and thus cause no agglomeration.

TABLE 1

| | Example No. | | |
|---|---|---|---|
| | 7 | 8 | 9 |
| Heat Fixing Accelerator | Ethyl N-phenyl-carbamate (53° C.)* | 1,3,5-Trimethoxy-benzene (51-53° C.)* | p-Toluene-sulfon-amide (156° C.)* |
| Fixing Temperature | 125° C. | 131° C. | 129° C. |
| Presevability | no agglomeation | no agglomeration | no agglom-eration |

(Note)
*melting point

The electrophotographic toner composition of the present invention has the aforementioned structure and thus can be fixed at a low temperature and exhibits an excellent preservability. Further, in a heat roll fixing process, it can inhibit offset. Accordingly, the copy image obtained by the image formation process of the present invention exhibits an excellent image quality.

While the invention has been described in detail and with reference to specific embodiments thereof, it will be apparent to one skilled in the art that various changes and modifications can be made therein without departing from the spirit and scope thereof.

What is claimed is:

1. An electrophotographic toner composition comprising a capsule toner having a core substance containing a binder resin and a coloring agent, encapsulated with an outer shell having an average thickness of 0.005 μm to 0.05 μm and being made of a resin which comprises a polyurea and/or a polyurethane having a glass transition point of 150° C. or lower, said resin allowing permeation of the core substance upon heating at a temperature higher than a glass transition temperature of the core substance.

2. The electrophotographic toner composition as in claim 1, which further comprises a fluidizing agent.

3. The electrophotographic toner composition as in claim 2, wherein said fluidizing agent is selected from the group consisting of silicon oxide, titanium oxide, aluminum oxide and zirconium oxide and has been surface-treated to be hydrophobic.

4. A process for fixing a toner composition containing a capsule toner, which comprises the steps of:

a) providing on a sheet a toner composition containing a capsule toner which comprises a core substance having a glass transition point of 60° C. or lower and being encapsulated with a shell made of a resin capable of allowing permeation of the core substance upon heating at a temperature higher than said glass transition temperature, and b) applying heat and pressure to said capsule toner to an extent that the shell is not ruptured, so that the core substance permeates through the shell to form a fixed image on said sheet.

5. A toner composition containing a capsule toner which comprises a core substance having a glass transition point of 60° C. or lower and being encapsulated with a shell made of a resin capable of allowing permeation of the core substance upon heating at a temperature higher than said glass transition temperature.

6. The toner composition as in claim 5, wherein said core substance consists essentially of a coloring agent and a binder resin.

7. The toner composition as in claim 6, wherein said binder resin is a linear polyester obtained by polycondensation reaction of a polyol component with a polycarboxylic acid, an acid anhydride thereof, or a lower alkyl ester thereof.

8. The toner composition as in claim 5, wherein said shell is made of a resin comprising a polyurea and/or polyurethane resin having a glass transition temperature of 150° C. or lower and has a shell average thickness of 0.005 μm to 0.5 μm.

9. The electrophotographic toner composition as in claim 1, wherein the core substance is encapsulated by only one shell.

10. The electrophotographic toner composition as in claim 1, wherein the toner composition has a heat-fixing temperature ranging from about 100° C. to about 180° C.

11. The process as in claim 4, wherein the core substance is encapsulated with a shell having an average thickness of 0.005 μm and being made of a resin which comprises a polyurea and/or a polyurethane having a glass transition temperature of 150° C. or lower.

12. The process as in claim 4, wherein the core substance is encapsulated by only one shell.

13. The process as in claim 4, wherein the shell is an outer shell.

14. The process as in claim 4, wherein the heat in step b) is applied at a temperature ranging from about 100° C. to about 180° C.

15. The electrophotographic toner composition as in claim 5, wherein the core substance is encapsulated with a shell having an average thickness of 0.005 μm and being made of a resin which comprises a polyurea and/or a polyurethane having a glass transition temperature of 150° C. or lower.

16. The electrophotographic toner composition as in claim 5, wherein the core substance is encapsulated by only one shell.

17. The electrophotographic toner composition as in claim 5, wherein the shell is an outer shell.

18. The electrophotographic toner composition as in claim 5, wherein the toner composition has a heat-fixing temperature ranging from about 100° C. to about 180° C.

* * * * *